United States Patent [19]

Brown

[11] Patent Number: 4,476,450

[45] Date of Patent: Oct. 9, 1984

[54] ELECTROMAGNETIC SOLENOID RELAY

[75] Inventor: Samuel J. Brown, South Lyon, Mich.

[73] Assignee: Essex Group, Inc., Fort Wayne, Ind.

[21] Appl. No.: 436,145

[22] Filed: Oct. 22, 1982

[51] Int. Cl.[3] ..... H01H 51/06; H01H 1/12

[52] U.S. Cl. ..... 335/196; 335/131; 335/133; 335/203

[58] Field of Search ..... 335/203, 131, 133, 196, 335/262, 193

[56] References Cited

U.S. PATENT DOCUMENTS

| | | | |
|---|---|---|---|
| 3,396,354 | 8/1968 | Fisher | 335/262 |
| 3,813,621 | 5/1974 | Blum | 335/193 |
| 4,063,204 | 12/1977 | McFarlin | 335/193 |
| 4,356,466 | 10/1982 | Brown et al. | 335/203 |

*Primary Examiner*—E. A. Goldberg
*Assistant Examiner*—George Andrews
*Attorney, Agent, or Firm*—Stephen A. Schneeberger

[57] ABSTRACT

A compact, flexible relay with plunger-type armature is provided. Relay configurations ranging from single-pole, single throw to double-pole, double-throw may be provided on the same base, using standardized components. A plurality of the relay terminals are placed in a stacked arrangement, including intermediate insulators, for minimizing the use of space transverse to the plunger armature. The terminals are integrally formed to include a plate portion for positioning parallel to the base and a depending blade portion extending transversely thereto for external electrical connections. Some of the terminals are included in the electromagnetic circuit. In a particular configuration, a double-pole, double-throw relay suited for dynamic braking of a motor is conveniently provided employing the stacked arrangement of terminals and several standardized components.

5 Claims, 6 Drawing Figures

FIG. 2
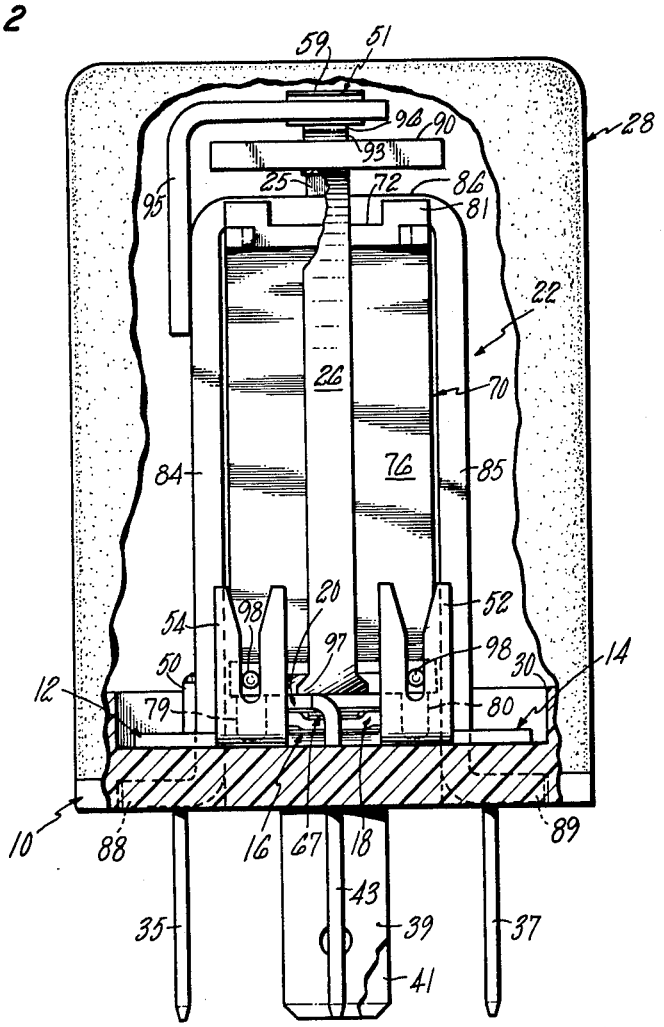
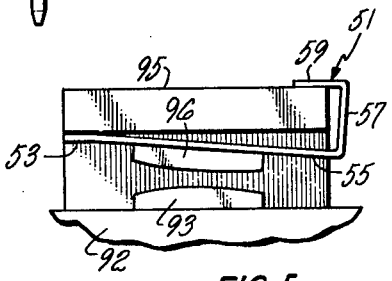
FIG. 5
FIG. 4
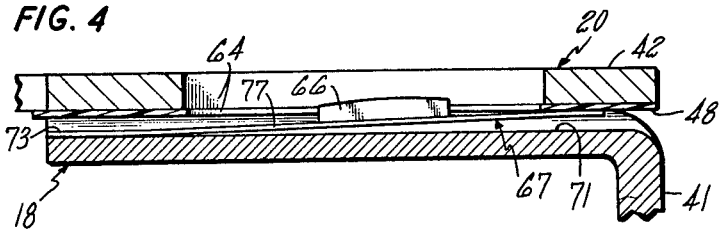

ELECTROMAGNETIC SOLENOID RELAY

DESCRIPTION

1. Technical Field

The invention relates in general to electromagnetic solenoid relays and more specifically to relays in which one or more electrical contacts is carried by a plunger armature. The invention relates more particularly still to the configuration of such relays.

2. Background Art

Solenoid relay constructions employing a plunger armature for moving an electrical contact into and out of engagement with another contact are well known, as exemplified by Hayden U.S. Pat. Nos. 4,003,011 and 4,064,770, Brown et al U.S. Pat. No. 4,044,322 and Brown et al allowed U.S. patent application Ser. No. 265,864 now Pat. No. 4,356,466. The relays of those patents have also employed a curved strip metal spring to bias the plunger armature to its at-rest position. Further, advantage for high current switching applications has been obtained through the well-known provision of magnetic blow-out of arcs established at the relay contacts, as exemplified in the aforementioned Brown et al patent and allowed patent application in which the relay contacts are located in a magnetic flux path extending from the relay armature to a stationary component of the relay electromagnet.

In relays generally, and particularly in relays of the aforementioned type, it is usually desirable to minimize manufacturing steps and cost, while maximizing the flexibility of relay configurations within a particular space. An example of such effort is illustrated in U.S. Pat. No. 3,211,875 to Bengtsson wherein a double-pole, double-throw relay includes a two-piece base of insulating material and a plurality of terminals joined therewith. The upper member of the two-piece base is of relatively detailed geometry, and the terminals are each formed of two parts, including a terminal pin press-fitted into a bracket portion. The head of each of the terminal pins is spun over to secure their terminals and base members in fixed relation. While certain space savings might be accomplished by such minimization of the use of solder joints and various fasteners, it is an object of the present invention to facilitate the manufacturing process and minimize the cost of manufacturing compact relays. Moreover, it is an object to assure good current-conducting characteristics for the relay terminals.

In those relays possesing a plunger armature and wherein the plunger is biased to its at-rest position by a relatively long, curved strip metal spring, there may be relativelyt little opportunity for reducing the verticl extent of the relay assembly. Therefore, it is an object particularly with relays of that type to minimize one or both of the relay's transverse dimensions which generally parallel the plane of the base.

Still further, in certain applications in which relays are utilized to control operation of inductive motors, the relay may be connected to the motor armature in a manner which affords dynamic braking of the motor when the relay disconnects the external current source. Specifically, in such circumstances the relay has a double-throw capability for shorting the motor armature. Most motors for which dynamic braking is provided are operated in a bidirectional manner, as for moving an automobile window up and down. Such operation requires the relay to be of the double-pole, double-throw type wherein the relay armatures are actuated independently of one another and wherein when the relay armatures are both in their at-rest positions, the motor armature is shorted. Moreover, when one or the other of the relay armatures is actuated by energization of the respective coil, one of two possible external circuits is completed with the motor armature for current to flow in one direction or the other to cause motor operation in one direction or the other. It is a still further object to provide a compact and economical relay particularly suited for such applications.

In accordance with the present invention, there is provided in a relay having a plunger-type armature, a relatively compact, economical, durable and flexible assemblage of elements. More specifically, there is provided such a relay ranging from a single-pole, single-throw to a double-pole, double-throw configuration on the same base and using various standardized components. Particularly, a plurality of the relay terminals are placed in a stacked arrangement, including intermediate insulators, for minimizing the use of space transverse to the plunger armature. The terminal stack typically includes three terminals spaced from one another by two respective insulators. The terminals are each integrally formed to include a plate portion for positioning parallel to the relay base and a depending blade portion extending transversely thereto for external electrical connections. At least some of the terminals are of ferromagnetic material such that their plate portions may provide a portion of the relay's electromagnetic circuit. The relay base is formed to accept and support terminals arranged in a plurality of conventional patterns.

In a particular configuration, a double-pole, double throw-relay suited for dynamic braking of a motr and possessing the aforementioned characteristics is conveniently provided. One set of identical, mirror-image terminals forms the base of a terminal stack and are suited for connection respectively to opposite ends of the armature of a motor and to the respective relay armatures. Another terminal in the stack is electrically common to the normally-closed contacts of both poles of the relay for connection to one source of electrical potential. Yet another terminal in the stack is electrically common to the normally-open contacts of both poles of the relay for connection to a source of different electrical potential.

BRIEF DESCRIPTION OF DRAWINGS

FIG. 2 is a sectional view taken substantially along line 2—2 of FIG. 1;

FIG. 4 is an enlarged view of a portion of the relay of FIG. 1 showing the lower armature bounce suppressor in greater detail;

FIG. 5 is an enlarged view of a portion of the relay of FIG. 1 with the armature actuated and showing the upper armature bounce suppressor in greater detail.

BEST MODE FOR CARRYING OUT THE INVENTION

Figure 1:
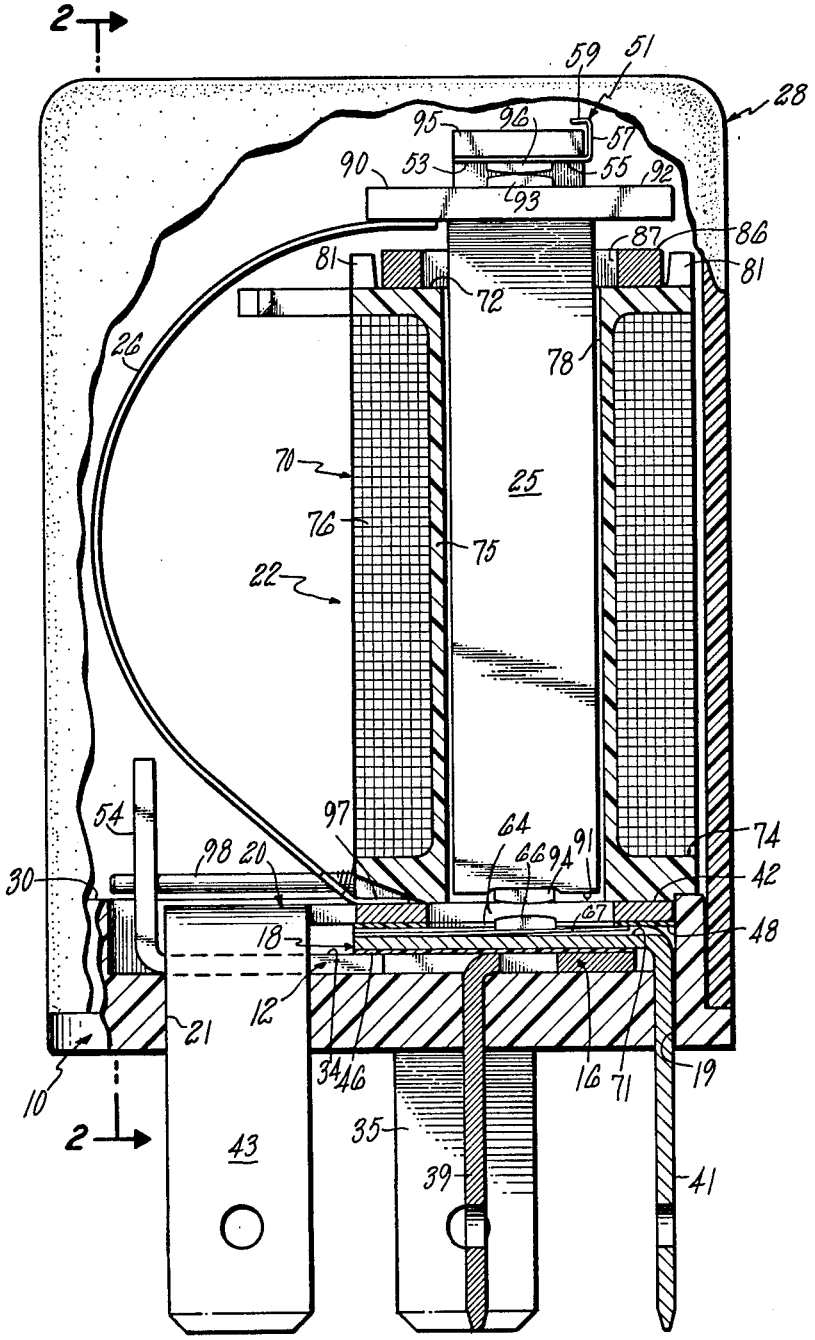
FIG. 1 is a side elevation, partly in section and with portions broken away, of an electromagnetic solenoid relay according to one embodiment of the present invention.

Referring now to the drawings, and particularly FIGS. 1–6, a solenoid relay in accordance with a first embodiment of the present invention includes a base 10, five terminals 12, 14, 16, 18 and 20 assembled, several in stack form, on the base 10, and an electromagnet 22 mounted on the base 10. A plunger armature 24 is slidably supported in the electromagnet 22 and is biased to an at-rest position shown in FIG. 1 by a resilient spring 26. A cover 28 may be provided to fit over the relay for protection against dirt and other foreign material.

The base 10 is generally square in shape, is relatively small, being about 2.6 cm on a side and may be molded as a single element from a suitable insulation material such as nylon resin. The base 10 has an upper planar supporting surface 29 surrounded by an upstanding rim 30. A number of generally rectangular slots extend most, but not all, of the way downwardly through the base 10 from its planar surface 29. A thin protective layer of the material of base 10, as for instance 0.1–0.2 mm thick provides the base at the lower end of each slot to prevent introduction of foreign material to the relay. The patterning of the slots is such as to include all major termination patterns. Various elements of the relay, including terminals 12, 14, 16, 18 and 20 and the electromagnet 22 include members which are installed through the base 10 by punching through the thin base in the respective slots. More specifically, in the illustrated embodiment of a single-pole, double-throw relay having a DIN termination pattern, five of the slots 13, 15, 17, 19 and 21 are sized and positioned to receive terminals 12, 14, 16, 18 and 20 respectively. Further, a pair of generally square slots 31 are also provided to receive a portion of the electromagnet 22. The base 10 may also have two projections 32 at its ends which are shaped to seat in correpsonding openings 33 in the cover 28.

The terminals 12, 14, 16, 18 and 20 are formed from a ferromagnetic material and are mounted upon the base 10 in stack form to provide a compact relay in accordance with an aspect of the invention. These terminals 12, 14, 16, 18 and 20 are each integral stampings of a generally inverted L-shaped configuration and have respective plate portions 34, 36, 38, 40 and 42 overlying the supporting surface 29 of the base 10 and respective integral blade portions 35, 37, 39, 41 and 43 by which electrical connections may be made. The blade portions 35, 37, 39, 41 and 43 are suitably disposed to extend through the slots 13, 15, 17, 19 and 21 respectively of the base 10, with blade portions 35 and 37 having barbs to resist removal. The plate portions 34, 36 and 38 of terminals 12, 14 16 respectively are sized and configured such that they may be positioned in substantially the same plane, adjacent to but spaced from one another on the surface 29 of base member 10. The terminal plate portions 40 and 42 are then assembled in stack form on the lowermost terminal plate 38 with a thin sheet (0.005 in., 0.12 mm) insulator 46 of a suitable material, such as the synthetic product Mylar or the like, interposed between the plate 40 and the plate 38 therebelow and another thin sheet insulator 48 of like material interposed between the plate portions 40 and 42. The terminals 12 and 14 typically are laterally outside the aforementioned stack of terminals and insulators. The plate portion 38 of the terminal 16 carries an upwardly extending tab 50 for welded connection with part of the electromagnet 22. The plate portions 34, 36 have respective upwardly extending lead pin connecting posts 52, 54. To assure accurate location of the terminals 16, 18, 20 relative to the base 10, each of the plate portions 38, 40, 42 and the insulators 46 and 48 has a pair of holes therethrough or semicircular notches in the sides thereof numbered 56, 58. The plate portion 38 of terminal 16 further includes a pair of notches 60, 62 along its edge portions, each notch matching a portion of a respective one of the pair of slots 31 in the base 10. In addition, the plate portion 42 of terminal 20 and the insulator 48 are each provided with a central aperture 64 therethrough in alignment with a contact 66 on terminal 18 to be described hereinafter in greater detail.

The electromagnet 22 comprises a generally U-shaped (inverted) bracket 68 of ferromagnetic material and a bobbin 70 which may be molded from a suitable insulation material such as a glass-filled nylon resin. The bobbin 70 includes two end flanges 72, 74 and a central tubular portion 75 about which an electrically energizeable coil 76 is wound between the flanges 72, 74. The bobbin 70 has a bore 78 of generally rectangular cross-section extending axially through the tubular portion 75 and the end flanges 72, 74. The lower flange 74 is provided with a pair of downwardly extending cylindrical lugs 79, 80 which project respectively through the aligned pairs of holes and notches 56, 58 of the plate portions 38, 40 and 42 and the insulators 46 and 48. The length of the lugs 79, 80 relative to the stacked thickness of plates 38, 40, 42 and insulators 46, 48 is such that the lower ends of the lugs terminate within the thickness of lowermost plate 38. These lugs 79, 80 are accurately located relative to the bobbin bore 78 to position the bore 78 in alignment with the apertures 64 of the plate portion 42 and insulator 48. The upper flange 72 is provided with a recessed channel provided by upstanding corner posts 81 for positioning of the bracket 68 relative to the bobbin 70. Additionally, the upper flange 72 includes a pair of spaced-apart support members 82 extending laterally from one end of the flange for supportedly engaging an associated circuitry package (not shown).

The bracket 68 comprises a pair of parallel leg portions 84, 85 joined by a bight portion 86 which overlies the bobbin end flange 72 and has an opening 87 therethrough in alignment with the bore 78 of the bobbin 70. The leg portions 84, 85 of the bracket 68 are located closely adjacent the edges of the bobbin end flanges 72, 74 and the bight portion 86 is snugly received in the channel formed by corner posts 81 of the end flange 72 to accurately position the bobbin 70 relative to the bracket 68. At the respective free ends of the leg portions 84, 85, the bracket 68 has two downwardly extending stud portions 88, 89. These stud portions 88, 89 project respectively, through the notches 60, 62 of the plate portion 38 and thence through the innermost portions of the pair of slots 31 where they are staked over in an outward direction against the lower surface of the base 10. The free ends of the leg portions 84, 85 are in engagement with the plate portion 38 of the terminal 16 and the bottom bobbin flange 74 engages the plate 42 of terminal 20 so as to maintain the stack form assembly of the terminals 16, 18, 20 and the insulators 46, 48 securely positioned between the base 10 and the bracket 68 and bobbin 70. Additionally, the bobbin 70 is retained in position between the plate portion 42 of the terminal 20 and the bight portion 86 of the bracket 68.

The armature 24 includes a square prismatic plunger body 25, and, in accordance with an aspect of the invention, a head flange 92, of ferromagnetic material. The plunger 25 is of rectangular cross-section and is slidably located in the bore 78 of the bobbin 70 for linear reciprocation as hereinafter described. The armature plunger 25 has four flat longitudinal sides extending between head flange 92 and a lower transverse end 91. All corners of the plunger 25 are preferably rounded slightly to insure free sliding movement of the armature in the bobbin bore 78. The armature head flange or plate 92 extends transversely of plunger 25 and defines an upper end 90 of armature 24. The head flange 92 may be an integral portion 25 of the armature 24 or it may be a separate element affixed thereto in a manner providing a low reluctance magnetic flux path therebetween, as by welding or brazing. In a preferred embodiment, the plunger 25 and head flange 92 are integral, being formed by cold heading. Upper and lower electrical contacts 93, 94 are affixed to the upper and lower ends 90, 91 of armature 24 and are formed of silver or other good nonmagnetic, electrical contact material which may be welded in place. Flange 92 is generally rectangular and of sufficient transverse extent beyond the bracket bight opening 87 and over most or all of bracket bight 86, in spaced relation therewith, such that the resulting flux path is between the bracket bight and the armature head flange and the resulting magnetic force is parallel to the longitudinal extent of armature plunger 25. Additionally, the bight opening 87 is made large relative to plunger 25 to increase the transverse or radial clearance between the plunger and bight 86 and thereby minimize fringing flux. For example, plunger 25 may have a cross-section of 0.11 in. (2.7 mm) by 0.24 in. (6 mm) with bight opening 87 being 0.21 in. (5.2 mm) by 0.31 in. (7.7 mm). It will thus be appreciated that a serial pair of magnetic air gaps are defined, one between head flange 92 and bracket bight 86 and the other between terminals 16, 18, 20 and the lower end of armature plunger 25 both acting parallel to the longitudinal extent of plunger 25.

Further in accordance with an aspect of the invention, the U-shaped bracket 68 includes an additional bracket 95, of inverted L shape and of electronically-conductive, nonmagnetic material, such as zinc-plated brass, extending upwardly from bracket leg 84 and across the top of bracket bight 86 in spaced relation therewith. An electrical contact 96 of suitable nonmagnetic material is positioned preferably adjacent the inner surface of bracket 95 in a manner to be hereinafter described, in facing alignment with the contact 93 on the upper end of armature 24. The L bracket 95 is affixed to the U bracket 68, as by welding, for providing a nonmagnetic, electrically conductive support for contact 96 and for establishing the at-rest position of armature 24 and thus, the air gap between the lower armature end 91 and terminal 18 respectively, as will be hereinafter described.

Figure 3:
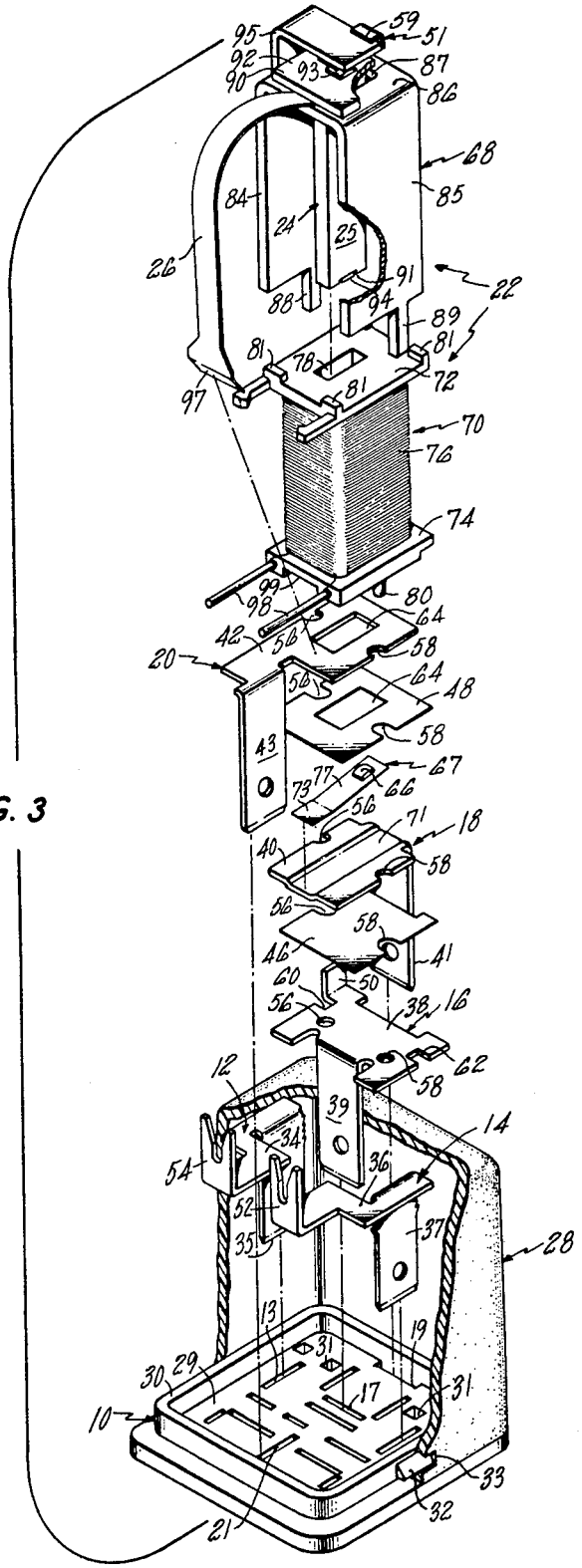
FIG. 3 is an exploded perspective view of various parts of the relay of FIGS. 1 and 2.

The resilient spring 26 is formed from a strip of spring metal having conductivity suitable to carry the relay's rated current. One such high conductivity spring material particularly applicable to the spring 26 is a silver-copper alloy marketed by thee C. G. Hussey Company as its Type SSC-155 alloy. The upper end of spring 26 is affixed, as by welding, to the under surface of the armature head flange 92. As shown in FIG. 3, the lower end of spring 26 includes a base portion 97 which is somewhat enlarged and prebent for welded, conductive attachment to the upper surface of terminal plate 42. As illustrated in FIG. 1, the length of spring 26 is such that it is elastically flexed into an arcuate shape when its base portion 97 is anchored and armature 24 is installed in the aperture 78 of bobbin 70, such that the armature 24 is urged upwardly to an at-rest position with its contact 93 in engagement with the contact 96 of bracket 95. The considerable length of spring 26 minimizes the effect of any small changes in its length and/or positioning.

In accordance with another aspect of the invention, bounce suppression for armature 24 is provided by resiliently mounting contact 16 and preferably also contact 96. The electrical contact 66 associated with plate 40 of terminal 18 is mounted on a resiliently yieldable member, such as leaf spring 67, to reduce or eliminate contact bounce when armature 24 is actuated. More specifically, a shallow channel having a depth of about 0.015 in. (0.38 mm) is coined in the front or upper surface of plate 40 on terminal 18. The length, width and thickness of leaf spring 67 are slightly smaller than that of the channel 71 in terminal plate 40 to permit installation of the spring therein, but sufficient to carry the rated current. Importantly, the thickness of spring 67 is less than the depth of the channel 71 at least in that region of the spring which supports contact 66, to allow some resilient displacement of the spring relative to terminal 18 when contact 66 is impacted by contact 94 on armature 24. Specifically, the spring 67 is of a nonmagnetic, electrically-conducting material such as that of spring 26 and may have a thickness of about 0.006 in. (0.15 mm) and include a base or anchorage portion 73 and a cantilevered arm portion 77 extending from the base portion at an upward angle of about fourteen degrees therewith. Spring base 73 is affixed, as by welding, to the base of channel 71 in terminal 18 to provide good electrical contact therewith. The upward angle of spring arm portion 77 is such that its distal end extends above the surface of terminal plate 40 until, as illustrated in FIG. 4, the insulator 48 is applied thereover in the stacked assembly of the terminals. In that assembled position, the undersurface of insulator 48 is positioned against the upper surface of terminal plate 40 and the free end portion of the arm portion 77 of spring 67 is urged downward to a flexed position substantially flush with the upper surface of terminal plate 40. The positioning of contact 66 along spring 67 is such that it is then in alignment with the contact 94 on the lower end of armature 24 and also affords a relatively large downward displacment of spring 67. The apertures 64 in terminal plate 42 and in insulator 48 permit downward actuation of the armature 24 and its contact 94 into yielding engagement with contact 66. Contact 66 is capable of being resiliently displaced downward a distance of about 0.008–0.009 in. (0.20–0.23 mm) to decelerate the actuated armature 24 in a gradual manner which damps and substantially eliminates contact bounce. Such range of displacement is obtainable by positioning contact 66 relatively outboard along spring 67. Tests have revealed that it typically takes 2–3 milliseconds or longer for prior art relay contacts to cease bouncing, whereas with the aforedescribed bounce suppressor of the present invention such cessation of contact bouncing occurs substantially instantaneously, being less than about 50 microseconds. It will also be appreciated that some other arrangement might be provided for resiliently supporting the contact 66, as for instance by affixing spring 67 to a pedestal in the groove 71 or by using a spring of a different configuration, though it is normally desirable that the spring be prestressed as by insulator 48. In any event, it is necessary to provide some spacing between contacts 66, 94 when the armature 24 is in its at-rest position and insulator 48 insures that spring 67 and contact 66 are stripped from contact 94 as the armature 24 returns to its at-rest position.

Although the contact 96 supported by L bracket 95 might be rigidly affixed to the undersurface thereof, it is preferable for purposes of contact bounce suppression to also resiliently mount that contact. Accordingly, reeferring to FIGS. 1–3 and 5, the contact 96 is welded onto a leaf spring 51 having characteristics generally similar to the lower contact spring 67. Specifically, spring 51 includes a base portion 53 welded to the undersurface of L bracket 95 and a contact-supporting portion 55 which is prebent downwardly from base portion 53 at an angle of 10°–15° therewith and on which contact 96 is mounted. Further, spring 51 includes a limit-arm portion 57 extending upwardly from portion 55 and terminating in a catch or lip 59 which extends inwardly over an edge of L bracket 95. It will be understood that lip 59 engages bracket 95 to stop or limit the displacement of spring 51 and its contact 96 in a return direction (downward, inward). This serves to strip the armature contact 93 away from spring contact 96. The length of limit arm 57 is selected to establish a slightly prestressed positioning of spring portion 55 when the contacts 93, 96 are disengaged, which positioning is effective upon engagement of contacts 93, 96 by the action of main spring 26 to allow sufficient upward (outward) displacement of the spring 51 and the contacts to provide significant contact bounce suppression, yet also enable the spring portion 55 to contact the L bracket 95 so as to provide a positive stop to which the contacts 93, 96 and the air gap formed between the lower armature and 91 and terminal 18 are referenced in the at-rest position. Typically that air gap is about 0.017 in. (0.45 mm) and that range of displacement of spring 51 at the location of contact 96 is about 0.008–0.010 in. (0.20–0.25 mm). It will be further evident that because the armature 24 is moved upward by main spring 26 to a limit position against the underside of L bracket 95 (through the intermediates of contacts 93, 96 and spring 51) in the at-rest position, the precise dimensions of the two aforementioned magnetic air gaps are easily provided during manufacture and maintained during repeated operation. It will be understood that a portion of bracket 95 might be formed to perform the functions of limit-arm 57 and lip 59 on spring 51, thus obviating the need to place them on the spring itself.

It will be observed that the configuration of the relay components provides a compact single-pole, double-throw relay which may be rapidly assembled in a simple manner. The terminals 12, 14, and 16 are positioned on base 10. Then insulator 46, terminal 18 with spring 67 and contact 66, and insulator 48 are stacked thereabove in succession. The base end 97 of spring 26 is welded to plate 42 of terminal 20, with the other end of the spring being welded to armature flange 92 to form a subassembly. Then the U bracket is placed over the bobbin 70, the armature plunger 25 is inserted through the bracket bight opening 87 into the bobbin bore 78, and the terminal 20 is moved into position on the terminal stack, thus arcuately flexing spring 26. The U bracket 68 and bobbin 70 are then moved down, with bracket studs 88, 89 punching through slots 31 in base 10 and the bobbin base flange 74 engaging terminal plate 42. A small relief channel 99 is provided in the underside of bobbin base flange 74 to afford unimpeded movement of main spring 26. The stud portions 88, 89 of bracket 68 are then staked over, beneath base 10, to secure the stationary parts in fixed relation. The tab 50 of terminal 16 and the L bracket 95 with spring 51 attached are then each welded to U bracket 68 at their respective positions. The end leads of coil 76 are wound about and soldered to a respective pair of lead pins and those pins are inserted into and soldered or welded to posts 52, 54. Finally, the cover 28 is placed over the relay assembly with the projections 32 on base 10 being received in cover openings 33.

In operation of the relay, the terminals 12 and 14 are connected through a control circuit to the respective poles of a battery for controlling energization of the coil 76. Terminal 20 provides the common terminal connected through spring 26 to armature 24 and its associated contacts 93, 94. The terminal 16 is electrically connected to the normally-closed contact 96, and the terminal 18 is electrically connected to the normally-open contact 66. Upon energization of the coil 76, a magnetic flux path is established across the gap between armature flange 92 and bracket bight 86 and across the gap between the lower armature end 91 and the plate 42 of terminal 20, thereby resulting in attractive magnetic forces at those gaps which act parallel to the armature plunger 25 to cause its actuation. The resistance of coil 76 is relatively high, being about 85 ohms, such that the resulting current, and thus magnetic field, is small and reliance is placed on the additive forces across the two aforementioned gaps to provide the requisite armature pull-in forces. Bounce suppresor spring 67 minimizes or eliminates any bounce between contacts 94, 66. When coil 76 is deenergized, the magnetic field collapses, and spring 26 acts to return armature 24 to its at-rest position. The bounce suppressor spring 67 moves relatively upward or outward until stopped or limited by insulator 48, whereupon the armature contact 94 is stripped from the terminal contact 66. The armature 24 continues its outward movement until it is slowed and stopped by bounce suppressor spring 51 adjacent L bracket 95.

Figure 6:
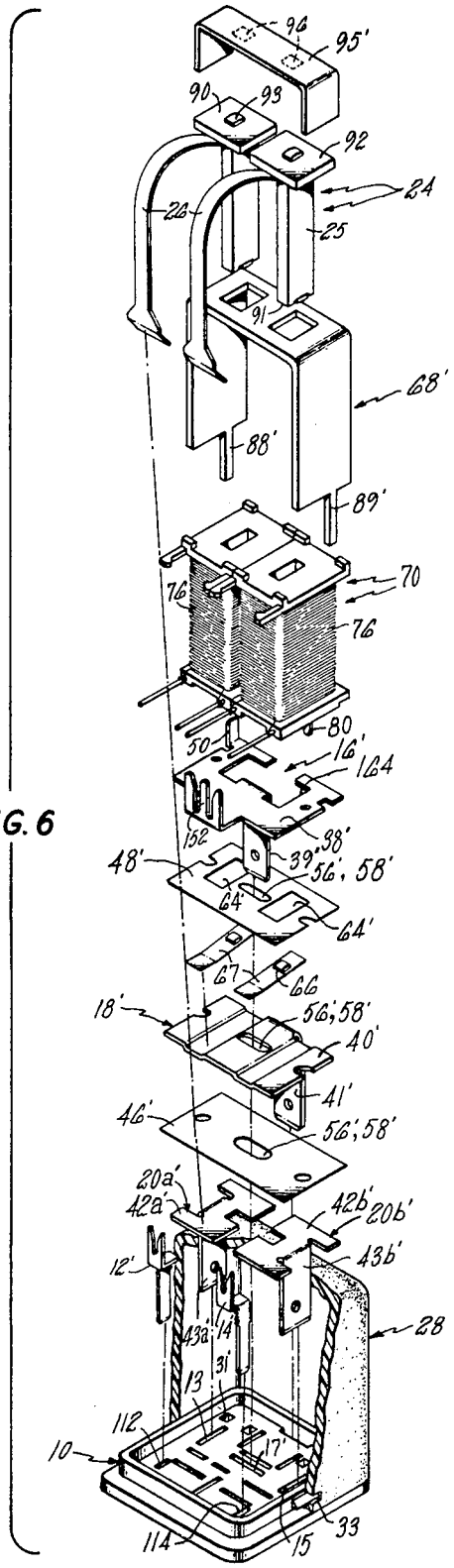
FIG. 6 is an exploded perspective view of an electromagnetic solenoid relay according to another embodiment of the present invention.

In accordance with an aspect of the invention, the stacking of the terminals permits a double-pole, double-throw relay, having dynamic braking capability, to be provided on the same base 10 and within the same cover 28, utilizing pairs of several standardized components including the armatures 24, springs 26 and bobbins and coils 70, 76 previously described. Referring to FIG. 6, such a double-pole, double-throw relay is depicted in exploded form. Those components which are identical to componenets described with reference to the single-pole, double-throw relay of FIGS. 1–5 are identified with the same reference numerals in FIG. 6 and will not require further description.

Components of the FIG. 6 double-pole, double-throw relay which are functionally and structurally similar to components in the FIG. 1–5 relay, but which accommodate both poles in a single, larger structure are identified with a primed reference numeral, and include U bracket 68' and a double L bracket 95'. The studs 88', 89' at the base of U bracket 68' extend through slots 31' in base 10 and are staked over. The double-L bracket 95' is joined at its midpoint such that it has the appearance of an inverted U.

Other components of the FIG. 6 relay embodiment have also been identified by primed reference numerals because of their similarity to FIG. 1 counterparts, but require some further discussion. For instance, the terminals 12' and 14' are somewhat smaller than their FIG. 1 counterparts and are each connected to an end of a separate coil 76, rather than to opposite ends of the same coil. Terminals 12' and 14' have barbed blade portions which extend through slots 112 and 114 of base 10.

Further, the terminal 16' includes a blade portion 39' insertable through a slot 17' in the base 10. Terminal 16' is arranged uppermost in the stack of terminals 16', 18' and 20' in this embodiment and thus is provided with an enlarged cutout portion 164' in its plate portion 38' to permit passage of the armatures 24. Terminal 16' includes a tab 50 for attachment to the U frame 68'. Terminal 16' also includes a connecting post 152 extending upwardly from plate portion 38' with a pair of notches therein for each receiving the pin connected to the remaining end of a respective one of each of the coils 76, and thus is electrically common to both coils and also to both contacts 96 on brackey 95'.

The upper and lower discrete insulators 48'0 and 46' respectively, and the terminal 18' each are provided with a transverse slot 56', 58' extending therethrough for receiving not only the lugs 79, 80 on the bobbins 70, but also to pass the blade portion 39' of terminal 16'. That slot 56', 58' in terminal 18' is sized to avoid electrical contact with terminal blade portion 39'. The terminal 18' also mounts two contacts 66 on respective springs 67 such that they are electrically common to one another. A pair of apertures 64' in insulator 48' permit passage of respective armatures 24.

A pair of electrically separate terminals **20*a'*, 20*b'* each include a respective blade portion 43*a'*, 43*b'* which extends through respective slots 13, 15 in base 10. The terminals 20*a'*, 20*b'* also include respective integral plate portions 42*a'*, 42*b'* and are so structured and positioned that they do not contact or provide an electrical path between one another, nor do they contact blade portion 39' of terminal 16'. Terminals 20*a'* and 20*b'* are geometrically identical and positioned in "mirror image" relation to one another such that only one shape is required. A respective main spring 26 is conductively affixed to each terminal 20*a'*, 20*b'* as previously described. Terminals 20*a'*, 20*b'* are adjacent the base 10** in the terminal stack of this embodiment.

In various relay applications involving the control of an inductive motor, as in raising and lowering the windows in an automobile, it is necessary to provide dynamic braking of the motor. This is done by maintaining the motor armature shorted, except when the "up" or the "down" relay coil is energized. As is known, such mode of motor control is most conveniently provided by a double-pole, double-throw relay, and the aforedescribed relay embodiment of FIG. 6 provides a particularly compact relay for such purpose.

Specifically, each blade portion **43*a'*, 43*b'* of the respective terminals 20*a'*, 20*b'* is electrically connected to a respective opposite end of the motor armature (not shown). Each terminal 20*a'*, 20*b'* is electerically connected, through respective springs 26, to respective relay armatures 24 and thus the contacts 94, 93 on the opposite ends thereof, The contacts 96 are electrically connected to terminal 16' which may in turn be connected to an external source of one electrical potential. The contacts 66 similarly are electrically connected to terminal 18' which may in turn be connected to an external source of another electrical potential. It will be apprectiated that when both relay armatures 24 are in their at-rest positions, a short circuit is created across the motor armature to effect dynamic braking. When one armature 24** (i.e. "up" or "down") is actuated the other (i.e. "down" or "up") normally is not actuated, such that the relative polarities of the external potential applied across the motor armature (and thus the direction of current flow therethrough) are in one direction or the other to effect motor operation in one direction or the other.

Although this invention has been shown and described with respect to detailed embodiments thereof, it will be understood by those skilled in the art that various changes in form and detail thereof may be made without departing from the spirit and scope of the claimed invention.

Having thus described a typical embodiment of my invention, that which I claim as new and desire to secure by Letters Patent of the United States is:

1. An electomagnetic solenoid relay of the type comprising:

a base of insulation material;

a coil bobbin mounted on said base and having a bore extending axially therethrough;

an electrically energizable coil wound on said bobbin;

a plunger armature guided in the bore of said bobbin for endwise reciprocatory motion between an at-rest position and an actuated position upon the energization and deenergization of said coil;

a first contact secured to an end of said armature;

ferromagnetic circuit means embracing said coil bobbin for attraction of said armature to its actuated position in response to the energization of said coil;

electrical terminal means;

a second contact electrically connected to said terminal means for engagement by said first contact upon movement of said armature to one of its said at-rest and actuated positions; and a resilient spring for urging said armature to its at-rest position, said electromagnetic solenoid relay being further characterized by:

said terminal means including discrete terminals, said second contact being electrically connected to a said terminal, each said terminal including a plate portion and an integral blade portion extending transversely from said plate portion, said terminal plate portion of a plurality of said terminals being arranged in stacked relationship with one another substantially parallel to and being supported by said base, said stacked relationship including terminal plate portions in at least three successive layers, said terminals being electrically insulated from one another and the respective said terminal blade portions extending through said base and externally of said relay, said terminals including first, second, third and fourth terminals each having a respective said plate portion in one of said at least three successive layers of plate portions, said resilient spring being electrically connected to said armature and to said first terminal, said second contact being electrically connected to said second terminal, a third contact secured to the other end of said armature and a fourth contact eletrically connected to said third terminal for engagement by said third contact upon movement of said armature to the other of said at-rest and activated positions, and further including a second said bobbin mounted on said base, a second said coil wound on said second bobbin, a second said plunger armature guided in the bore of said second bobbin, second ferromagnetic circuit means embracing said second coil bobbin, a second said resilient spring for urging said second armature to its at-rest position, said second resilient spring being electrically connected to said second armature and to said fourth terminal, a fifth contact secured to an end of said second armature, a sixth contact electrically connected to said second terminal for engagement by said fifth contact upon movement of said second armature to one of its said at-rest and actuated positions, a seventh contact secured to the other end of said second armature, and an eigth contact electrically connected to said third terminal for engagement by said seventh contact upon movement of said second armature to the other of its said at-rest and actuated positions, whereby there is provided a double-pole, double-throw relay for dynamic breaking.

2. The relay of claim 1 including sheet-like insulating means interposed between each adjacent pair of terminal plate portions in said stacked arrangement thereof.

3. The relay of claim 1, wherein the respective plate portions of said first and fourth terminals are both in the same layer of said stacked arrangement of terminal plate portions.

4. The relay of claim 1 further including:

electrically conductive second spring means, said second contact being electrically connected with and resiliently supported by said second spring means to thereby damp contact bounce, said second spring means being electrically connected with a second said terminal; and stop means positioned for coactive engagement with said second means to thereby limit displacement of said second spring means and accordingly, said second contact, in the direction in which said armature and first contact retreat therefrom, thereby to insure separation of said first and said second contacts.

5. An electromagnetic solenoid relay of the type comprising:

a base of insulation material;

a coil bobbin mounted on said base and having a bore extending axially therethrough;

an electrically energizable coil wound on said bobbin;

a plunger armature guided in the bore of said bobbin for endwise reciprocatory motion between an at-rest position and an actuated position upon the energization and deenergization of said coil;

a first contact secured to an end of said armature;

ferromagnetic circuit means embracing said coil bobbin for attraction of said armature to its actuated position in response to the energization of said coil;

electrical terminal means;

a second contact electrically connected to said terminal means for engagement by said first contact upon movement of said armature to one of its said at-rest and actuated positions; and a resilient spring for urging said armature to its at-rest position, said eletromagnetic solenoid relay being further characterized by:

said terminal means including discrete terminals, said second contact being electrically connected to a said terminal, each said terminal including a plate portion and an integral blade portion extending transversely from said plate portion, said terminal plate portions of a plurality of said terminals being arranged in stacked relationship with one another substantially parallel to and being supported by said base, said terminals being electrically insulated from one another and the respective said terminal blade portions extending through said base and externally of said relay;

said ferromagnetic circuit means including a substantially U-shaped ferromagnetic bracket embracing said coil bobbin and secured to said base, said bracket having a pair of parallel leg portions extending from said base alongside said bobbin and joined by a bight portion overlying one end of said bobbin, said bight portion having an opening therethrough in alignment with the bore of the bobbin through which an outer portion of said plunger projects, said opening in said bight portion of said bracket being substantially larger than the portion of said armature projecting therethrough;

said outer portion of said armature including a flange of ferromagnetic material which has a surface of substantial surface area facing said bight portion of said bracket to provide a low reluctance magnetic flux path between said armature and said bight portion for attraction of said flange to said bight portion in a direction endwise of said armature in reponse to the energization of said coil, the length of said armature being such that said flange comes into contiguous but not contacting relation with said bight portion upon movement of said armature to its actuated position; and an armature stop secured to said bracket and engageable by means on said outer portion of said armature to define an at-rest position of said armature when said flange is spaced a predetermined distance from said bight portion.

* * * * *